United States Patent [19]

Jones

[11] Patent Number: 4,843,674

[45] Date of Patent: Jul. 4, 1989

[54] SWEEP MOP PAD HOLDER

[75] Inventor: Anthony M. Jones, Lodgefield Park, United Kingdom

[73] Assignee: Scot Young Service Systems Limited, West Midlands, England

[21] Appl. No.: 243,289

[22] Filed: Sep. 9, 1988

[30] Foreign Application Priority Data

Sep. 11, 1987 [GB] United Kingdom ..... 8721439

[51] Int. Cl.[4] ..... A47L 13/258

[52] U.S. Cl. ..... 15/147 R; 15/228

[58] Field of Search ..... 15/147 R, 147 A, 147 B, 15/147 C, 149, 154, 228, 229.1–229.9

[56] References Cited

U.S. PATENT DOCUMENTS

| | | | |
|---|---|---|---|
| 1,256,989 | 2/1918 | Duncan | 15/228 |
| 2,192,861 | 3/1940 | Burchell | 15/147 A |
| 2,840,840 | 7/1958 | Yamen | 15/147 R |
| 2,932,048 | 4/1960 | Yamen et al. | 15/147 R |
| 3,458,886 | 8/1969 | Goettel | 15/147 R |
| 3,911,521 | 10/1975 | Franchot | 15/147 R |

FOREIGN PATENT DOCUMENTS

| | | | |
|---|---|---|---|
| 3714178 | 2/1988 | Fed. Rep. of Germany | 15/147 R |

*Primary Examiner*—Edward L. Roberts

*Attorney, Agent, or Firm*—Collard, Roe & Galgano

[57] ABSTRACT

A collapsible mop pad holder comprises two opposite end leaves pivotally mounted on a central support which is connectible to a handle, and a catch operative to latch the end leaves in an erected condition. The catch comprises a latch member pivotally mounted on one of the leaves and depressible from a latching position, in which it engages the other leaf to latch both leaves together and thus maintains the erected condition of the holder, to an unlatching position in which it is retained until the mop pad holder is collapsed. The arrangement is such that on re-erection of the mop pad holder the latch member automatically re-assumes the latching position.

8 Claims, 3 Drawing Sheets

SWEEP MOP PAD HOLDER

BACKGROUND OF THE INVENTION

1. Field of the Invention

The invention relates to sweep mops which comprise a mop pad mounted on a pad holder attached through an articulating joint to a handle, so that the operative area of the pad lies flat on the floor as the mop is used with a sweeping action. Such mops are in general use for mopping of large floor areas, such as in hospitals and offices for example.

2. Description of the Prior Art

Particularly for use in a wet mopping system, including a mopping unit comprising a mop bucket combined with a wringer having two squeeze rollers between which the mop pad can be wrung out, collapsible pad holders are known which comprise two wing-like leaves hinged to a central support connected to the handle so that, when collapsed, the pad hangs down and can be pulled through the wringer. Locking of the leaves, in a generally aligned position, when the holder is erected is achieved by releasable catch or latch means. Prior arrangements in which the end leaves are each latched to the central support are complex, and/or inconvenient or difficult to operate, in respect of the catch or latch means.

It has been proposed that the catch arrangement should be operative to latch the two leaves directly one to the other in the region of the central support, thereby maintaining the erected condition of the holder. According to this proposal the catch arrangement comprises a catch block provided as an inner end extension of one leaf and engaging the side limbs of a wire frame forming the other leaf, thus utilizing the flexibility and resilience of that frame for resilient catch engagement.

Although the foregoing proposal has advantages, particularly that of reduced handling, as compared with prior catch arrangements it requires that at least one of the leaves be a wire frame and has a further drawback in that the effective catch engagement depends on the weight of the mop pad used, such pads being available in a range of thicknesses or weights.

SUMMARY OF THE INVENTION

The present invention has the aim of providing the advantages of latching the two leaves one to the other, rather than separately to the central support, without the drawbacks of said prior proposal.

According to the invention a collapsible mop pad holder comprises two opposite end leaves pivotally mounted on a central support connected or connectible to a handle, and catch means comprising a latch member mounted on one of the leaves and depressible from a latching position, in which it engages the other leaf to latch both leaves together and thus maintain the erected condition of the holder, to an unlatching position which is retained until the mop holder is collapsed with the arrangement being such that on re-erection of the mop holder the latch member automatically assumes said latching position.

Preferably the catch member is pivotally mounted on said one leaf and resiliently urged, as by a return spring, towards the latching position. In that position it may project upwardly from an aperture in the other leaf adjacent the inner end of the latter which is extended inwardly beyond its pivot mounting. Preferably the inner end extension of said other leaf partially overlaps the inner end of said one leaf on which the latch member is pivotally mounted, and the projecting latch member may have latching engagement with an edge of said aperture.

The latch member may be pivotable about an axis disposed laterally of the pad holder, that is parallel to the respective pivotal axes of collapsing movement of the two leaves. It may be retained in the depressed position, until the pad holder is collapsed, by engagement with a retaining formation on the central support which formation it clears, on re-erection of the pad holder after the latch member has been spring-returned to the latching position.

The latch member, the central support and both end leaves are conveniently plastics mouldings, to provide a pad holder consisting substantially entirely of a snap-together assembly of plastics mouldings. Such a plastics assembly, particularly employing the hand operation of the catch means which is achievable with the invention, is especially suitable for a mop to be used for the cleaning of wall surfaces, as in corridors for example, and large window areas.

Other features of the invention will be apparent from the following description, drawings and claims, the scope of the invention not being limited to the drawings themselves as the drawings are only for the purpose of illustrating a way in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENT

Figure 1:
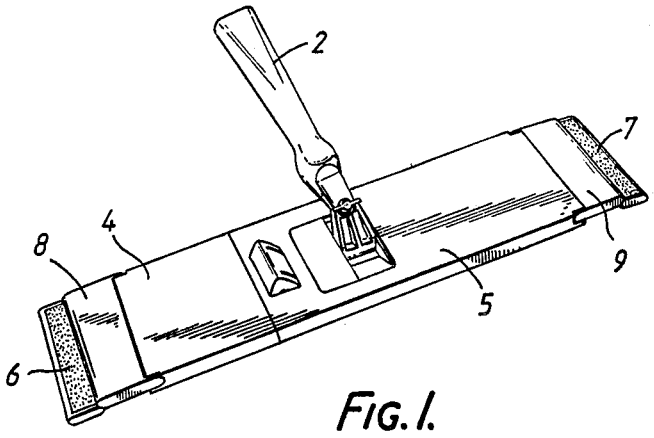
FIG. 1 is a top perspective view showing a mop holder in accordance with the invention in an erected condition.
Figure 2:
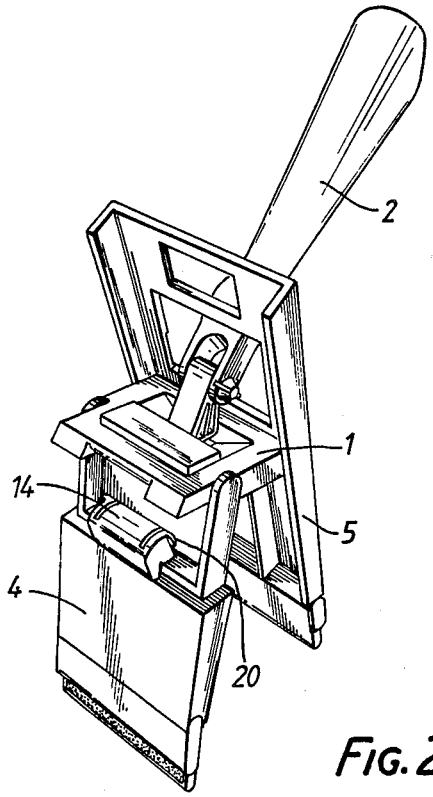
FIG. 2 is a similar view showing the mop holder in collapsed condition.
Figure 3:
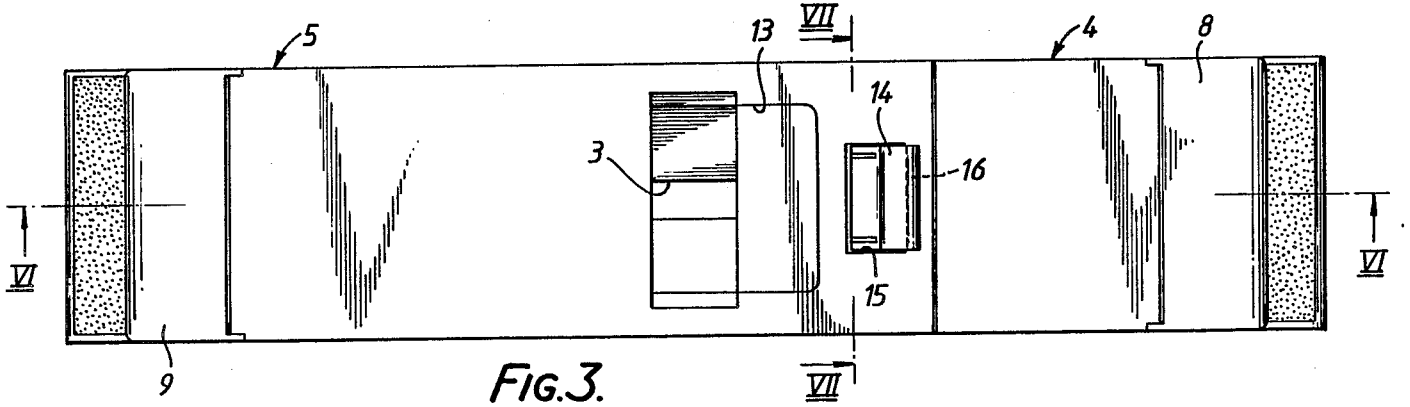
FIG. 3 is a plan view with a handle mounting assembly removed.
Figure 4:
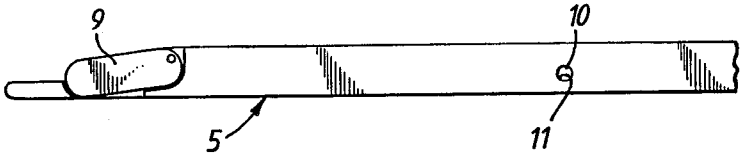
FIG. 4 is a partial side view of one end of the pad holder.
Figure 6:
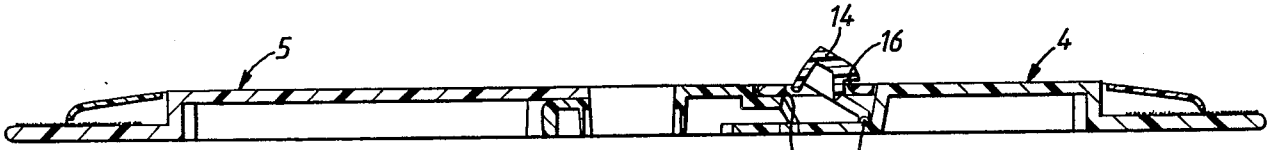
FIG. 6 is a longitudinal sectional view on the line VI—VI in FIG. 3.
Figure 5:
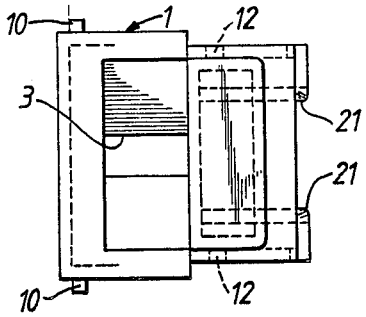
FIG. 5 is a plan view of a central support block.

The mop pad holder illustrated comprises a central support block 1, in the form of a plastics moulding, to which a handle (not shown) is attachable by means of a universally-jointed handle mounting 2 which is shown only in FIGS. 1 and 2 and which clips into a mounting aperture 3 in the block 1. Opposed end leaves 4 and 5, also plastics mouldings, are pivotally mounted on the block 1. The leaves 4 and 5 are of rectangular shape in plan view with outer ends to which the ends of a mop pad (not shown) can respectively be secured. In the erected operative condition of the holder the leaves 4 and 5 are aligned, as shown in FIGS. 1, 3 and 6 with the pad held stretched in flat configuration below the pad holder.

In the present embodiment the mop pad is wrapped around the ends of the leaves 4 and 5 to which it is secured by hook-and-loop fastening strips 6 and 7 of "Velcro" type. The ends of the pad are held down by spring loaded clip members, 8 and 9, which are pivotally mounted on the leaves and prevent the ends of the pad curling up away from the securing strips 6 and 7. The block 1 is moulded with oppositely projecting pivot stubs 10 which snap into respective pivot bores 11 moulded in the leaf 5, to define the lateral pivotal axis of the latter. In a similar but converse manner, the leaf 4 is moulded with opposed and inwardly projecting pivot stubs (not shown) which snap into pivot bores 12 in the block 1.

The inner end of the leaf 5 is extended beyond the handle mounting 2, which projects through a rectangular aperture 13, so as partially to overlap the inner end of the leaf 4. A latch member 14 is pivotally mounted on the overlapped portion of the leaf 4, being pivotal about a lateral axis and projecting through a smaller rectangular aperture 15 in the leaf 5 adjacent the inner end thereof. The latch member 14 is resiliently urged by a return spring (not shown) to the latching position illustrated more particularly in FIG. 6 in which it has latching engagement at 16 over the inner end edge of the aperture 15. This latches the leaves 4 and 5 one to the other, maintaining them in alignment and the pad holder in erected condition.

Figure 7:
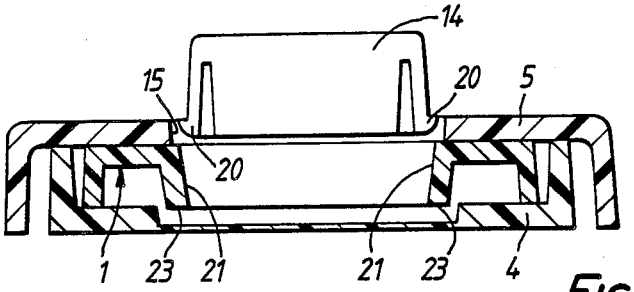
FIG. 7 is a lateral sectional view on the line VII—VII in FIG. 3 to a larger scale.
Figure 8:
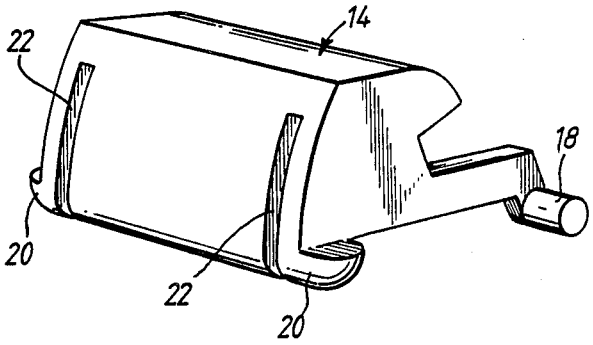
Figs. 8 and 9 are illustrative perspective views of a latch member of the pad holder.
Figure 9:
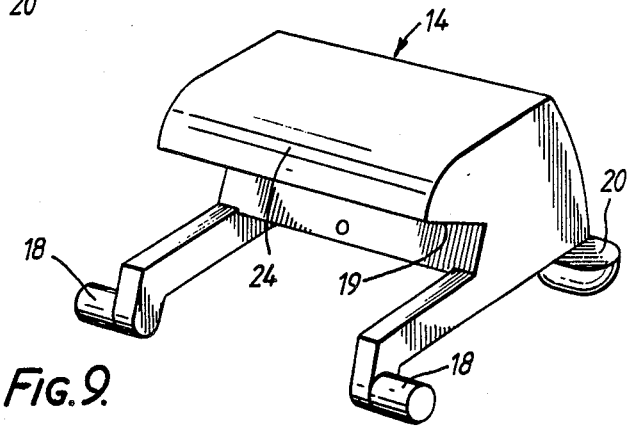

The detailed shape of the moulded latch member is illustrated particularly in FIGS. 8 and 9, and the function thereof will now be described with particular reference thereto and to FIGS. 6 and 7. The latching function is clearly illustrated in FIG. 6 and has already been described. To release the latch and allow the mop holder to collapse the latter is rested on the floor, for example, and the latch member 14 depressed by foot or hand. It pivots at 17 about a lateral axis defined by opposed projecting pivot stubs which snap into pivot bores in the leaf 4 on assembly of the pad holder. The downward pivotal movement of the latch member 14, as it is depressed, causes it to move into the aperture 15 and the latching surface clears the previously engaged edge of that aperture.

As the latch member 14 is depressed and moves out of latching engagement, two opposite side ears 20 on the moulded latch member 14 engage and slide along inclined side faces 21 of a rectangular end cut-out in the moulded block 1. The inclination of these faces 21 and the curved under surfaces of the ears 20 cause the latter to be cammed inwards, against the resilience provided by two slits 22 which allow the moulding 14 to flex and accommodate the inward movement of the ears 20. At the end of pivotal movement of the latch member 14 the ears 20 leave the side faces 21 and snap out, under the natural recovery of the moulding 14, to engage beneath the under surfaces 23 of the block 1 disposed alongside the faces 21 and which provide a latch retaining formation. This engagement retains the latch member 14 in the unlatching position, leaving the pad holder free to collapse when it is lifted by the handle, as shown in FIG. 2. In the collapsed condition of the pad holder, with the mop pad draped in a loop below the leaves 4 and 5, the mop can be wrung out with the mop pad being doubled to pass through a wringer. Thus collapsing of the mop and wringing out can be accomplished without handling of the wet mop.

During the free collapsing movement of the leaf 4, the path of arcuate movement of the latch member 14 takes the ears 20 free from the retaining engagement with the block 1 and hence the latch member is returned to the normal latching position under the influence of its return spring. To erect the pad holder the handle is positioned as shown in FIG. 2 so that the handle mounting 2 can be held so that it engages the edge of the aperture 13 in the leaf 5 to support and hold the latter at a suitable inclination for it to be engaged with the floor with the leaves 4 and 5 suitably mutually inclined, whereupon pressing the collapsed mop down upon the floor will move the leaves 4 and 5 apart and back to the erected condition. As they approach mutual alignment, the curved nose 24 of the latch member 14 engages the radiused under-surface of the latching edge of the aperture 15, which displaces the latch member 14 from the latching position sufficiently to clear that edge. When the aligned condition is reached, the return spring moves the latch member 14 back to the latching position and into latching engagement with the leaf 5. Thus erection, after wringing out the mop pad, can also be accomplished without handling of the wet mop.

While I have illustrated and described my invention in its preferred form, it will be apparent that the same is subject to alteration and modification without departing from the underlying principles involved, and I accordingly do not desire to be limited to the specific details illustrated and described except as may be necessitated by the appendant claims.

What is claimed is:

1. A collapsible mop pad holder comprising two opposite end leaves pivotally mounted on a central support connected or connectible to a handle, and catch means operative to latch the end leaves in an erected condition of the holder, wherein said catch means comprise a latch member mounted on one of the leaves and depressible from a latching position, in which it engages the other leaf to latch both leaves together and thus maintain the erected condition of the holder, to an unlatching position in which it is retained until the mop pad holder is collapsed with the arrangement being such that on re-erection of the mop pad holder the latch member automatically assumes said latching position, and means on said holder for retaining said latch member in said unlatching position.

2. A collapsible mop pad holder according to claim 1, wherein the latch member is pivotally mounted on said one leaf and resiliently urged, as by a return spring, towards the latching position.

3. A collapsible mop pad holder according to claim 1, wherein the latch member when in the latching position, with the holder erected, projects upwardly from an aperture in the other leaf adjacent the inner end of the latter which is extended inwardly beyond its pivot mounting.

4. A collapsible mop pad holder according to claim 3, wherein the inner end extension of said other leaf partially overlaps the inner end of said one leaf on which the latch member is pivotally mounted.

5. A collapsible mop pad holder according to claim 3, wherein the projecting latch member has latching engagement with an edge of said aperture when the mop pad holder is erected.

6. A collapsible mop pad holder according to claim 1, wherein the latch member is pivotable about an axis disposed laterally of the mop pad holder.

7. A collapsible mop pad holder according to claim 1, wherein the latch member is retained in the depressed position, until the mop pad holder is collapsed, by engagement with a retaining formation on the central support forming said retaining means which formation it clears on re-erection of the mop pad holder after the latch member has returned to the latching position.

8. A collapsible mop pad holder according to claim 1, wherein the latch member is resiliently compressible laterally of the holder between two side projections of the latch member, the central support has an end recess with inwardly and downwardly inclined side walls forming said retaining means and engaged by said projections as the latch member pivots to said depressed position, and the projections then engage beneath the central support to retain the latch member in the depressed position until the holder is collapsed.

* * * * *